US010779073B2

(12) United States Patent
Kirkpatrick

(10) Patent No.: US 10,779,073 B2
(45) **Date of Patent: *Sep. 15, 2020**

(54) MOLDABLE EARPIECE SYSTEM

(71) Applicant: Decibullz LLC, Fort Collins, CO (US)

(72) Inventor: Kyle J Kirkpatrick, Loveland, CO (US)

(73) Assignee: Decibullz LLC, Fort Collins, CO (US)

( * ) Notice: Subject to any disclaimer, the term of this patent is extended or adjusted under 35 U.S.C. 154(b) by 27 days.

This patent is subject to a terminal disclaimer.

(21) Appl. No.: 16/127,120

(22) Filed: Sep. 10, 2018

(65) Prior Publication Data

US 2019/0028790 A1 Jan. 24, 2019

Related U.S. Application Data

(63) Continuation of application No. 15/707,953, filed on Sep. 18, 2017, now Pat. No. 10,091,571, which is a continuation of application No. 15/485,967, filed on Apr. 12, 2017, now Pat. No. 9,769,555, which is a continuation of application No. 15/251,923, filed on Aug. 30, 2016, now Pat. No. 9,628,889, which is a continuation of application No. 13/761,947, filed on Feb. 7, 2013, now Pat. No. 9,451,353.

(60) Provisional application No. 61/596,567, filed on Feb. 8, 2012.

(51) Int. Cl.

| | |
|---|---|
| ***H01Q 1/12*** | (2006.01) |
| ***H04R 1/10*** | (2006.01) |
| *H04R 9/06* | (2006.01) |

(52) U.S. Cl.

CPC ..... *H04R 1/1016* (2013.01); *H04R 1/1058* (2013.01); *H04R 9/06* (2013.01)

(58) Field of Classification Search

CPC combination set(s) only.
See application file for complete search history.

(56) References Cited

U.S. PATENT DOCUMENTS

| | | | |
|---|---|---|---|
| 516,135 | A | 3/1894 | Thamm |
| 904,715 | A | 11/1908 | McWilliams |
| 2,377,739 | A | 6/1945 | Wyckoff |
| 2,430,229 | A | 11/1947 | Kelsey |
| 2,521,414 | A | 9/1950 | Schier |
| 2,881,759 | A | 4/1959 | Hocks et al. |

(Continued)

FOREIGN PATENT DOCUMENTS

| | | | |
|---|---|---|---|
| CN | 101073288 | A | 11/2007 |
| CN | 104160719 | A | 11/2014 |

(Continued)

OTHER PUBLICATIONS

U.S. Appl. No. 61/596,567, filed Feb. 8, 2012.

(Continued)

*Primary Examiner* — Amir H Etesam
(74) *Attorney, Agent, or Firm* — Craig R. Miles; CR Miles P.C.

(57) ABSTRACT

An earpiece including an external surface having a first fixed configuration disposable within the outer ear and having a passage adapted for retention of an in ear device, the earpiece heatable to achieve a moldable condition which allows reconfiguration of the external surface by engagement with the outer ear to dispose the external surface in a second fixed configuration in greater conformity to the outer ear.

14 Claims, 10 Drawing Sheets

(56) References Cited

U.S. PATENT DOCUMENTS

| | | | | |
|---|---|---|---|---|
| D185,740 | S | 7/1959 | Criswell | |
| D206,665 | S | 1/1967 | Sanzone | |
| D208,784 | S | 10/1967 | Sanzone | |
| 3,415,246 | A | 12/1968 | Hill | |
| 3,440,365 | A | 4/1969 | Bryant et al. | |
| D266,271 | S | 9/1982 | Johanson et al. | |
| D266,590 | S | 10/1982 | Bennett | |
| 4,412,096 | A | 10/1983 | Edgerton et al. | |
| D278,363 | S | 4/1985 | Schenkel et al. | |
| 4,537,187 | A | 8/1985 | Scott | |
| 4,579,112 | A | 4/1986 | Scott | |
| D290,203 | S | 6/1987 | Berry, Jr. | |
| 4,702,238 | A | 10/1987 | Scott | |
| 4,880,076 | A | 11/1989 | Ahlberg et al. | |
| 4,965,838 | A * | 10/1990 | Kamon | H04R 1/1016 381/380 |
| 5,002,151 | A | 3/1991 | Oliveira et al. | |
| 5,048,092 | A | 9/1991 | Yamagishi et al. | |
| 5,185,802 | A | 2/1993 | Stanton | |
| 5,321,757 | A | 6/1994 | Woodfill, Jr. | |
| 5,659,156 | A | 8/1997 | Mauney et al. | |
| 5,676,068 | A | 10/1997 | Kallander | |
| 5,711,313 | A | 1/1998 | Fleming | |
| 5,718,244 | A | 2/1998 | Thornton | |
| 5,753,781 | A | 5/1998 | Oxman et al. | |
| 5,881,159 | A | 3/1999 | Aceti et al. | |
| 6,082,485 | A | 7/2000 | Smith | |
| 6,122,388 | A | 9/2000 | Feldman | |
| 6,301,367 | B1 | 10/2001 | Boyden et al. | |
| 6,310,961 | B1 | 10/2001 | Oliveira et al. | |
| 6,354,990 | B1 | 3/2002 | Juneau et al. | |
| 6,434,248 | B1 | 8/2002 | Juneau et al. | |
| 6,445,865 | B1 | 9/2002 | Janus et al. | |
| 6,595,317 | B1 | 7/2003 | Widmer et al. | |
| 6,688,421 | B2 | 2/2004 | Dyer et al. | |
| 6,690,807 | B1 | 2/2004 | Meyer | |
| 6,761,789 | B2 | 7/2004 | Juneau et al. | |
| D505,132 | S | 5/2005 | Linville et al. | |
| 7,130,437 | B2 | 10/2006 | Stonikas et al. | |
| D535,642 | S | 1/2007 | Garcia et al. | |
| 7,217,335 | B2 | 5/2007 | Juneau et al. | |
| D550,202 | S | 9/2007 | Meier et al. | |
| 7,403,629 | B1 | 7/2008 | Aceti | |
| D593,076 | S | 5/2009 | Kung et al. | |
| 7,548,211 | B2 * | 6/2009 | Platz | H01Q 1/085 343/702 |
| 7,627,131 | B2 | 12/2009 | Nielsen et al. | |
| 7,628,366 | B2 | 12/2009 | Scott | |
| D622,265 | S | 8/2010 | Rye | |
| 7,778,434 | B2 | 8/2010 | Juneau et al. | |
| 7,889,883 | B2 | 2/2011 | Cartwright et al. | |
| D635,547 | S | 4/2011 | Komiyama | |
| 8,027,638 | B2 | 9/2011 | Sanguino et al. | |
| D656,129 | S | 3/2012 | Kelly et al. | |
| 8,184,838 | B2 | 5/2012 | Solomito et al. | |
| 8,201,561 | B2 | 6/2012 | Blanchard | |
| D667,817 | S | 9/2012 | Otani | |
| 8,280,093 | B2 | 10/2012 | Siahaan et al. | |
| D721,354 | S | 1/2015 | Thompson et al. | |
| 8,931,489 | B2 | 1/2015 | Smith | |
| D729,764 | S | 5/2015 | Arjomand | |
| D735,169 | S | 7/2015 | Shieh | |
| D752,026 | S | 3/2016 | Yang | |
| D754,638 | S | 4/2016 | Krissman | |
| 9,451,353 | B2 | 9/2016 | Kirkpatrick | |
| 9,628,889 | B2 | 4/2017 | Kirkpatrick | |
| 9,769,555 | B2 | 9/2017 | Kirkpatrick | |
| 2001/0043708 | A1 * | 11/2001 | Brimhall | H04R 25/456 381/328 |
| 2003/0048916 | A1 | 3/2003 | Chen | |
| 2003/0099370 | A1 | 5/2003 | Moore | |
| 2005/0099341 | A1 * | 5/2005 | Zhang | H01Q 1/38 343/700 MS |
| 2005/0147269 | A1 * | 7/2005 | Oliveira | H04R 1/10 381/382 |
| 2006/0098833 | A1 | 5/2006 | Juneau et al. | |
| 2006/0177082 | A1 | 8/2006 | Solomito et al. | |
| 2008/0187161 | A1 | 8/2008 | Tiemens et al. | |
| 2009/0041287 | A1 | 2/2009 | Quinlisk | |
| 2009/0141923 | A1 | 6/2009 | Smith | |
| 2009/0190786 | A1 | 7/2009 | Miskiel et al. | |
| 2009/0214072 | A1 | 8/2009 | Staab et al. | |
| 2009/0232342 | A1 | 9/2009 | Oliveira et al. | |
| 2009/0252362 | A1 | 10/2009 | Ooi et al. | |
| 2010/0027824 | A1 | 2/2010 | Atamaniuk et al. | |
| 2010/0086158 | A1 | 4/2010 | Oberlander | |
| 2012/0057739 | A1 | 3/2012 | Smith et al. | |
| 2012/0189146 | A1 | 7/2012 | Wuidart | |
| 2013/0216086 | A1 | 8/2013 | Kirkpatrick | |
| 2015/0382123 | A1 | 12/2015 | Jobani | |

FOREIGN PATENT DOCUMENTS

| | | |
|---|---|---|
| EP | 0895703 | 2/1999 |
| EP | 1032243 | 8/2000 |
| EP | 2107827 | 10/2009 |
| GB | 2470177 | 11/2010 |
| WO | WO 1992/003894 | 3/1992 |
| WO | WO 1999/031935 | 6/1999 |
| WO | WO 00/42817 | 7/2000 |
| WO | WO 2012/024656 | 2/2012 |

OTHER PUBLICATIONS

U.S. Appl. No. 13/761,947, filed Feb. 7, 2013.

PCT Interantional Patent Application No. PCT/US2013/025288, filed Feb. 8, 2013.

Angell. PodFitKit for Apple earbuds announced. iLounge, website, http://www.ilounge.com, originally downloaded Dec. 31, 2012, 4 total pages.

E-Bay. New SUGRU Black 3 pack Moldable Self Setting Rubber Customize Your Earbuds. Website, http://www.ebay.com, originally downloaded Dec. 31, 2012, 4 total pages.

Fuze Custom Earphones. On-line Catalog, http://www.earfuze.com, originally downloaded Dec. 31, 2012, 1 page.

How-To Geek. How to Make Custom Silicone Ear Molds for Your In-Ear Monitors. Website, http://www.howtogeek.com, originally downloaded Dec. 31, 2012, 20 total pages.

Lloyds. Custom Ear Mold—Standard. On-line Catalog, http://lloydhearingaid.com, originally downloaded Dec. 31, 2012, 1 page.

Mylobie.Com. Lobies—comfortable earbuds adapters for iPod, iPhone, and portable audio.Website, http://www.mylobie.com, originally downloaded Dec. 31, 2012, 1 page.

Zapconnect. Hearing Aid Moldable Impression Silicone Putty. Website, http://www.zapconnect.com, originally downloaded Dec. 31, 2012, 1 page.

Zenplugs Moulded Earplug Shop. Zenpods Blue Molded Earphone Adaptors . . . On-line Catalog, http://shop.zenplugs.com, originally downloaded Dec. 24, 2013, 1 page.

PCT Interantional Patent Application No. PCT/US2013/025288; ISR dated Jun. 2, 2013, 11 total pages.

U.S. Appl. No. 14/611,332, filed Feb. 2, 2015.

U.S. Appl. No. 14/930,066, filed Nov. 2, 2015.

U.S. Appl. No. 29/536,192, filed Aug. 14, 2015.

Corresponding European Patent Application No. 13746012.7; European Search Report, dated Jan. 27, 2016, 6 pages total.

Corresponding Chinese Patent Application No. 201380013425.X; Office Action and Search Report dated Oct. 8, 2016, 8 pages total.

Corresponding European Patent Application No. 13746012.7; Office Action dated Nov. 18, 2016, 5 pages total.

U.S. Appl. No. 15/707,953, filed Sep. 18, 2017.

U.S. Appl. No. 16/198,459, Office Action dated Jun. 12, 2019.

Chinese Patent Application No. 201380013425.X; 2nd Office Action dated Mar. 31, 2017, 8 pages total.

Chinese Patent Application No. 201380013425.X; 3d Office Action dated Aug. 2, 2017, 7 pages total.

U.S. Appl. No. 15/481,983, filed Apr. 7, 2017.

(56) References Cited

OTHER PUBLICATIONS

U.S. Appl. No. 15/411,901, filed Jan. 20, 2017.
U.S. Appl. No. 15/684,012, filed Aug. 23, 2017.
U.S. Appl. No. 15/411,901, Office Action dated Feb. 2, 2018.
PCT International Patent Application No. PCT/US20/23527; International Search Report and Written Opinion of the International Searching Authority dated Jun. 19, 2020, 11 pages.
Australian Patent Application No. 2018210187, Examination Report No. 1 dated Apr. 17, 2020.
Chinese Patent Application No. 201880007453.3; Office Action dated Jun. 1, 2020, 11 pages.
U.S. Appl. No. 16/661,253; Office Action dated Jun. 10, 2020.

* cited by examiner

MOLDABLE EARPIECE SYSTEM

This United States Patent Application is a continuation of U.S. patent application Ser. No. 15/707,953, filed Sep. 18, 2017, which is a continuation of U.S. patent application Ser. No. 15/485,967, filed Apr. 12, 2017, now U.S. Pat. No. 9,769,555, issued Sep. 19, 2017, which is a continuation of U.S. patent application Ser. No. 15/251,923, filed Aug. 30, 2016, now U.S. Pat. No. 9,628,889, issued Apr. 18, 2017, which is a continuation of U.S. patent application Ser. No. 13/761,947, filed Feb. 7, 2013, now U.S. Pat. No. 9,451,353, issued Sep. 20, 2016, which claims the benefit of U.S. Provisional Patent Application 61/596,567, filed Feb. 8, 2012, each hereby incorporated by reference herein.

I. TECHNICAL FIELD

An earpiece including an external surface having a first fixed configuration disposable within the outer ear and having a passage adapted for retention of an in ear device, the earpiece heatable to achieve a moldable condition which allows reconfiguration of the external surface by engagement with the outer ear to dispose the external surface in a second fixed configuration in greater conformity to the outer ear.

II. BACKGROUND

A wide variety of apparatus which deliver sound to the ear such as medical equipment, headsets, hearing aids, cellular telephones, and the like include in part in ear devices such as earphones, earplugs, earbuds, ear tips, ear tubes, or the like which are not configured to the outer ear of the individual wearer.

Because conventional in ear devices are not configured to the individual wearer's outer ear, the in ear device may not stay in fixed engagement with the outer ear, or the in ear device may not align with the outer portion of the ear canal, or the in ear device may be uncomfortable for the wearer to insert into or retain in the outer ear.

The instant invention provides a moldable earpiece which retains conventional in ear devices to overcome in whole or in part certain of the forgoing disadvantages associated with conventional in ear devices.

III. SUMMARY OF THE INVENTION

Accordingly, a broad object of the invention can be to provide a moldable earpiece which includes an external surface disposed in a first fixed configuration disposable within the outer ear of an ear of a wearer and having a passage adapted for retention of an in ear device which upon heating to a moldable condition allows reconfiguration of the external surface by engagement with the outer ear of a wearer and upon cooling disposes the external surface of the earpiece in a second fixed configuration which retains the in ear device and has greater conformity with the outer ear of the wearer.

Another broad object of the invention can be to provide a method of making a moldable earpiece for retention of an in ear device which includes forming an earpiece to dispose the external surface in a first fixed configuration disposable within the outer ear of an ear and further including a passage adapted for retention of an in ear device capable upon heating of achieving a moldable condition which allows reconfiguration of the external surface of the earpiece by engagement with an outer ear of an ear and upon cooling disposes the external surface in a second fixed configuration having greater conformity with the outer ear.

Another broad object of the invention can be to provide a kit for production of an earpiece which retains an in ear device and which has greater conformity with the wearer's outer ear, the kit including a moldable earpiece having a passage adapted for retention of the in ear device which upon heating to a moldable condition allows reconfiguration of the external surface by engagement with the wearer's outer ear and upon cooling disposes the external surface in a second fixed configuration having greater conformity to the wearer's outer ear and which retains the in ear device.

Another broad object of the invention can be to provide a method of molding an earpiece which retains an in ear device by obtaining an moldable earpiece having an external surface disposed in a first fixed configuration disposable within the outer ear of an ear and having a passage adapted for releasable retention of the in ear device and which by heating the earpiece to achieve a moldable condition allows reconfiguration of the external surface by engagement with said outer ear of said ear and by cooling the earpiece while engaged with the outer ear disposes the external surface in a second fixed configuration having greater conformity with the outer ear.

Naturally, further objects of the invention are disclosed throughout other areas of the specification, drawings, photographs, and claims.

IV. A BRIEF DESCRIPTION OF THE DRAWINGS

V. DETAILED DESCRIPTION OF THE PREFERRED EMBODIMENTS

Figure 1:
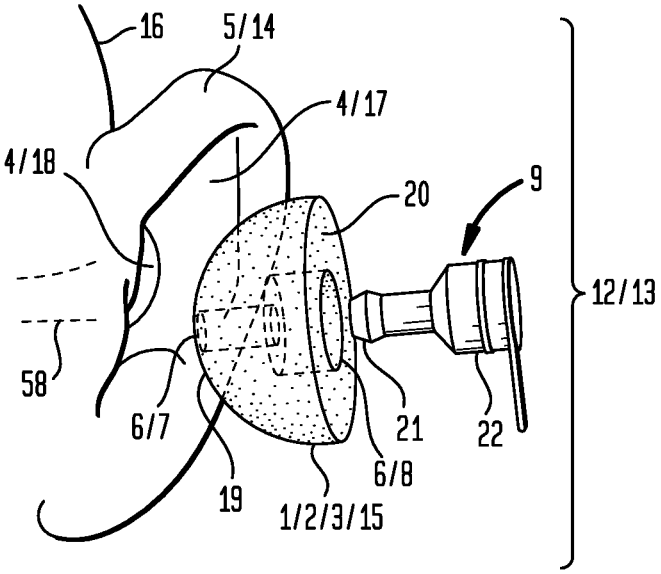
FIG. 1 is side perspective view which illustrates a step of a particular method of using an embodiment of the inventive earpiece in a first fixed configuration with a particular in ear device in the form of an ear speaker.

Generally referring to FIGS. 1 through 8, which illustrate a generic embodiment of an inventive moldable earpiece (1)(also referred to as an "earpiece") having an external surface (2) disposed in a first fixed configuration (3) disposable within the outer ear (4) of an ear (5). The earpiece (1) having a passage (6) which communicates between a first location (7) and a second location (8) on the external surface (2) of the earpiece (1) and adapted for retention or releasable retention of an in ear device (9) in the earpiece (1). The earpiece (1) can be heated to achieve a moldable condition (10) which allows reconfiguration of the external surface (2) by engagement within the outer ear (4) and can be cooled while engaged with the outer ear (4) to dispose the external surface (2) in a second fixed configuration (11) conformed more closely to the configuration of the outer ear (4). As to particular embodiments, the earpiece (1) can be provided separate from but capable of use with one or more of a wide variety of in ear devices (9), for example: earphones, earplugs, earbuds, ear tips, ear tubes, ear speakers, and in ear hearing aids, or the like. As to particular embodiments, the in ear devices (9) can be a part of an apparatus (57) worn or which resides outside of the ear (5), for example: headsets, head phones, telephones, blue tooth headphones, wireless headphones, hearing aids, medical apparatus, or the like. As to other embodiments, the earpiece (1) and the in ear device (9) can be provided in combination as part of a moldable earpiece system (12) or the earpiece (1) can be provided as part of a kit (13) which can be used by a wearer (14) for production of an earpiece (1) having greater conformity with the wearer's (14) outer ear (4) for retention or releasable rentention of an in ear device (9).

Embodiments of the moldable earpiece (1) having an external surface (2) disposed in the first fixed configuration (3) can be formed from an amount of moldable material (15). The term "moldable material" means for the purpose of this invention any material which retains a fixed configuration disposable within the outer ear (also referred to as the "first fixed configuration" (3)) at temperatures below about 40° C. (110° F.) and achieves a moldable condition (10) in a temperature range of about 40° C. (about 110° F.) and about 65° C. (150° F.) which allows the external surface (2) of the earpiece (1) to be reconfigured by engagement with the outer ear (4) and allows the passage (6) to be reconfigured by engagement with an in ear device (9) with the material remaining moldable at temperatures sufficiently low to avoid injury to the outer ear (4) or damage to the in ear device (9) and which cures at ambient temperature or while engaged with the outer ear (4) to retain a fixed configuration conformed more closely to the configuration of the outer ear (4) (also referred to as the "second fixed configuration" (11)).

The amount of moldable material (15) can be one or more of, combinations of, or admixtures of one or more thermoplastic polymers suitable for use with the invention, such as: polyethylene, polypropylene, polyvinyl chloride (PVC), polystyrene, polyester, polycaprolactone, polytetrafluoroethylene, acrylonitrile butadiene styrene, or the like.

As one illustrative example, embodiments of the earpiece (1) can be formed from an amount of polycaprolactone polymer (CAS No.: 24989-41-4); however, other thermoplastic polymers suitable for use with embodiments of the invention can have physical properties as those described in Table 1 for polycaprolactone polymer, or similar physical properties which allow the material to be utilized in one or more of the embodiments of the earpiece (1).

TABLE 1

Physical Properties of Polycaprolactone Thermoplastic Polymers

| Physical Property | ASTM Test | |
|---|---|---|
| Molecular Weight | | |
| Mn | GPC, THF, 25° C. | 37,000 ± 2000; 47500 ± 2000; 69000 ± 1500 |
| Mw | GPC, THF, 25° C. | 84500 ± 1000; 120000 ± 2000 |

TABLE 1-continued

| Physical Properties of Polycaprolactone Thermoplastic Polymers | | | |
|---|---|---|---|
| Physical Property | ASTM Test | | |
| Mz | GPC, THF, 25° C. | 130000 ± 5000; 178500 | |
| Polydispersity (Mw/Mn) | | 1.78 | 1.74 |
| Melt Flow Index | D 1238 | | |
| 80° C., 2.16 kg, g/10 min | | 2.36 | 0.59 |
| 80° C., 21.6 kg, g/10 min | | 34.6 | 9.56 |
| 190° C., 2.16 kg, g/10 min | | 28 | 7.29 |
| Thermal Analysis (DSC) | | | |
| Melting Point ° C. | | 60-62 | 60-62 |
| Heat Of Fusion, DHm, J/g | | 76.9 | 76.6 |
| Crystallinity, % | | 56 | 56 |
| Crystallisation Temperature, ° C. | | 25.2 | 27.4 |
| Glass Transition Temperature, Tg, ° C. | | −60 | −60 |
| Tensile Properties | | | |
| Yield Stress, s y, Mpa | D 412-87 | | |
| 100 mm/min | | 17.5 | 16 |
| 500 mm/min | | 17.2 | 14 |
| Modulus, E. Mpa | D 412-87 | | |
| 1 mm/min | | 470 | 440 |
| 10 mm/min | | 430 | 500 |
| Draw Stress, s d, MPa | D 412-87 | | |
| 100 mm/min | | 12.6 | 11.9 |
| 500 mm/min | | 11.5 | 11 |
| Draw Ratio, l d, x | D 412-87 | | |
| 100 mm/min | | >4.2 | 4 |
| Stress At Break, s b, Mpa | D 412-87 | | |
| 100 mm/min | | 29 | 54 |
| Strain At Break, e b, % | | | |
| 100 mm/min | D 412-87 | >700 | 920 |
| Flexural Modulus, E, MPa | | | |
| 2 mm/min | D 790 | 411 | nd |
| Hardness | D 2240 | | |
| Shore A | | 95 | 94 |
| Shore D | | 51 | 50 |
| Viscosity | | | |
| Pa. sec, 70° C., 10 1/sec | | 2890 | 12650 |
| Pa. sec, 100° C., 10 1/sec | | 1353 | 5780 |
| Pa. sec, 150° C., 10 1/sec | | 443 | 1925 |

As to the illustrative example, polycaprolactone polymers provide a biodegradable polyester with a range of molecular weights in the range of 37,000 and 80,000 each having a melting point of about 60° C. useful in making and using embodiments of the earpiece (1). Polycaprolactone polymers impart good water, oil, solvent, and chlorine resistance. Polycaprolactone polymers are also compatible with wide range of other materials (collectively referred to as "admixed agents" (38)), such as: starch to impart greater biodegradability; colorants, such as alcohol dyes or acrylic coloring agents; powders such as acrylic powder; particulates of plastic, copolymer plastics, metal, bismuth oxychloride, or glitter; or the like, either separately or in various combinations. Polycaprolactone polymers are non-toxic and approved by the United States Food and Drug Administration for specific applications in the human body.

Figure 2:
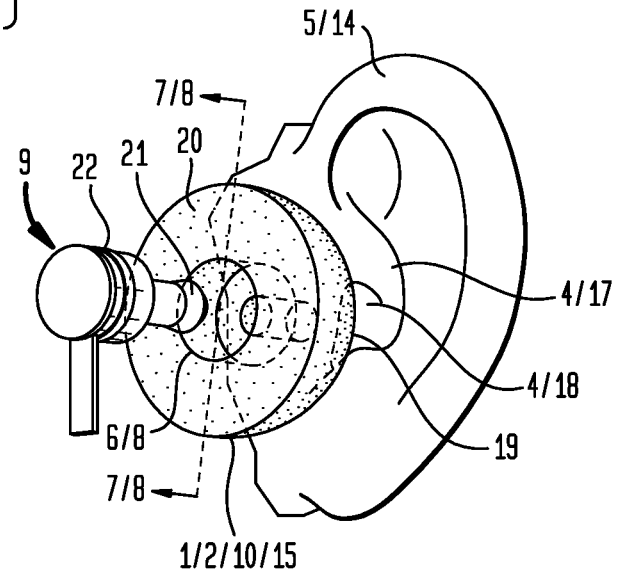
FIG. 2 is front perspective view which illustrates a step of a particular method of using an embodiment of the inventive earpiece in a first fixed configuration with the particular in ear device shown in FIG. 1.
Figure 3:
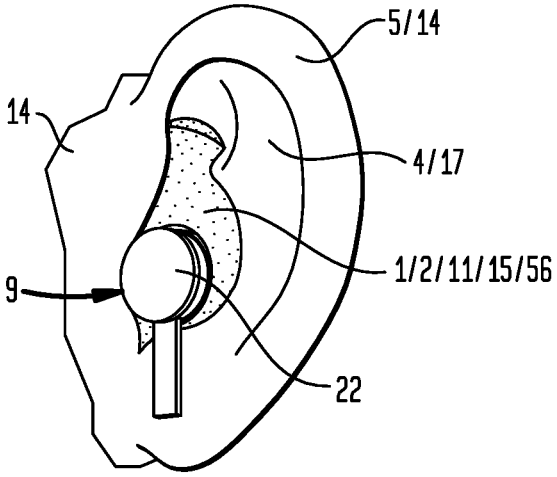
FIG. 3 is a front view which illustrates a step of a method of using an embodiment of the inventive earpiece in a second fixed configuration engaged to the particular in ear device shown in FIG. 1.
Figure 4:
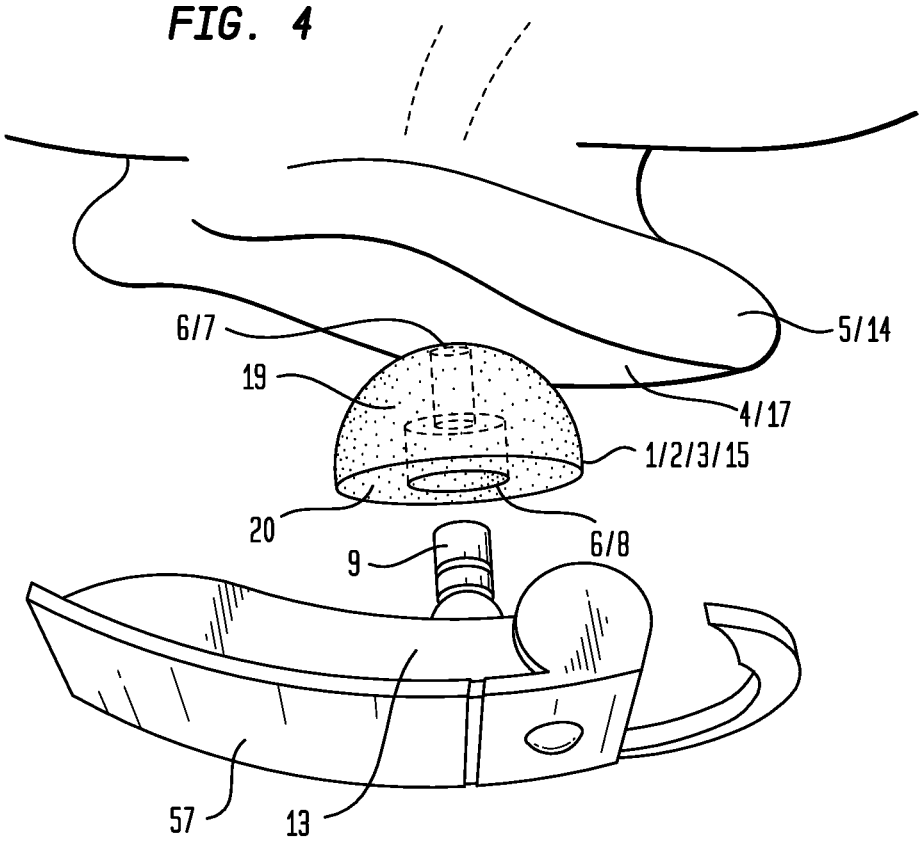
FIG. 4 is a top perspective view which illustrates a step of a method of using an embodiment of the inventive earpiece with a particular in ear device which is part of an apparatus which resides outside the ear in the form of a hands free head set.

The term "outer ear" for the purposes of this invention includes the visible part of the ear that resides outside of the head (16) (also referred as the "auricle") which in part includes the outer ear bowl (17) and the outer portion of the open ear canal (18) (also referred to herein as the "concha") having skin that moves with that of the outer ear bowl (17)(as shown in the example of FIG. 2).

The term "ear canal" for the purposes of this invention includes that part of the ear canal (58) from the outer portion of the open ear canal (18) to the location at which in ear canal hearing aids (59) are conventionally worn.

Figure 19:
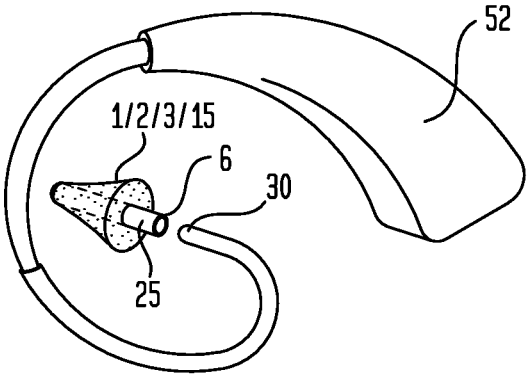
FIG. 19 is a front perspective view of a particular embodiment of the earpiece in a first fixed configuration having a conduit which extends outwardly to couple to an speaker tube of an apparatus worn outside the ear in the form of a hearing aid.
Figure 21:
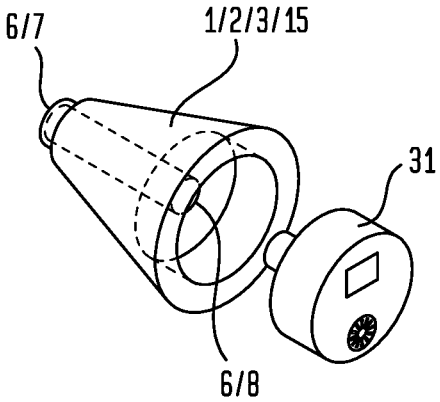
FIG. 21 is a front perspective view of an embodiment of the earpiece in a first fixed configuration adapted to retain a particular embodiment of an in ear device in the form of an in ear hearing aid.

Now referring primarily to FIGS. 1 through 18, particular embodiments of the earpiece (1) can be formed from an amount of moldable material (15) to provide an external surface (2) disposed in a first fixed configuration (3) disposable in the outer ear (4). The first fixed configuration (3) can provide a first portion (19) of the external surface (2) configured to allow or facilitate engagement with a part of the outer ear (4). As illustrative examples, embodiments can have the first portion (19) of the external surface (2) configured generally as a hemisphere (as shown in the examples of FIGS. 1, 2, 4 and 5) or configured generally in droplet shape or comma shape (as shown in the example of FIG. 10 through 15) or configured as a truncated cone (as shown in the examples of FIGS. 19 and 21); however, as to other embodiments, the first portion (19) of the external surface (2) can be configured in any other configuration which facilitates engagement of the earpiece (1) in the first fixed configuration (3) with a part of the outer ear (4), the outer ear bowl (17), or the outer portion of the ear canal (18).

The remaining second portion (20) of the external surface (2) can be formed in the first fixed configuration (3) to provide a generally flat surface (as shown in the examples of FIGS. 1, 2, 4, 5, 7, 8, 12, 19 and 21); although the second portion (20) of the external surface (2) in the first fixed configuration (3) can be configured in any form which allows the passage (6) adapted for retention or releasable retention of the in ear device (9) to communicate between a first location (7) and a second location (8) on said external surface (2) of said earpiece (1).

Figure 7:
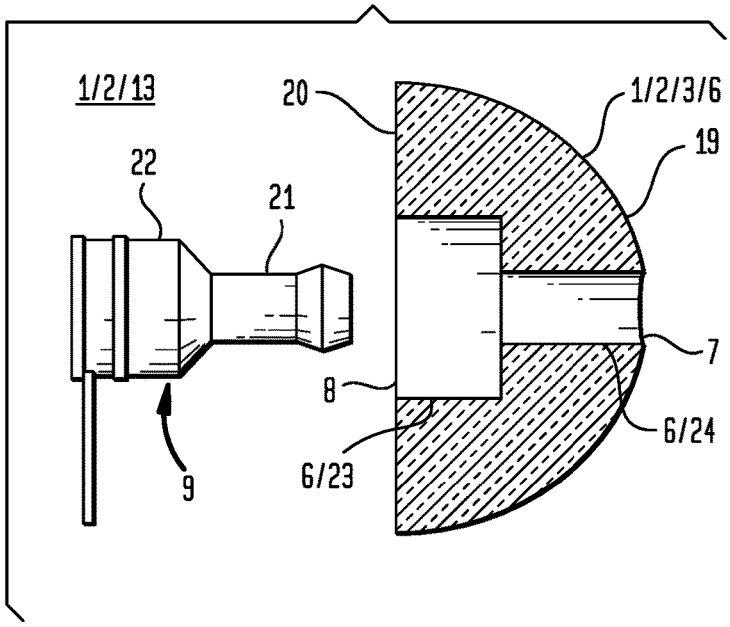
FIG. 7 is a cross section 7-7 of the particular earpiece shown in FIG. 2.
Figure 8:
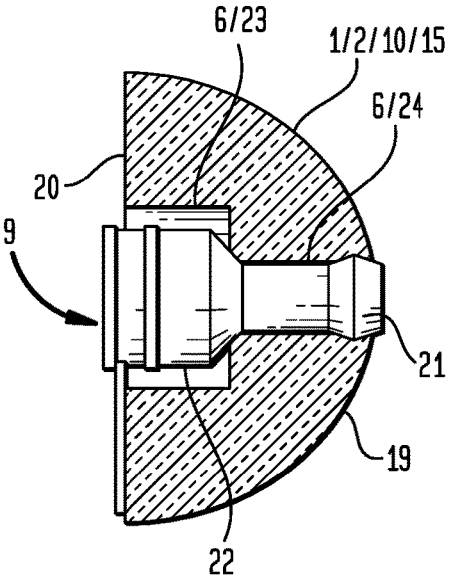
FIG. 8 is cross section 8-8 having the particular earpiece shown in FIGS. 2 and 7 engaged with the in ear device shown in FIG. 7.
Figure 9:
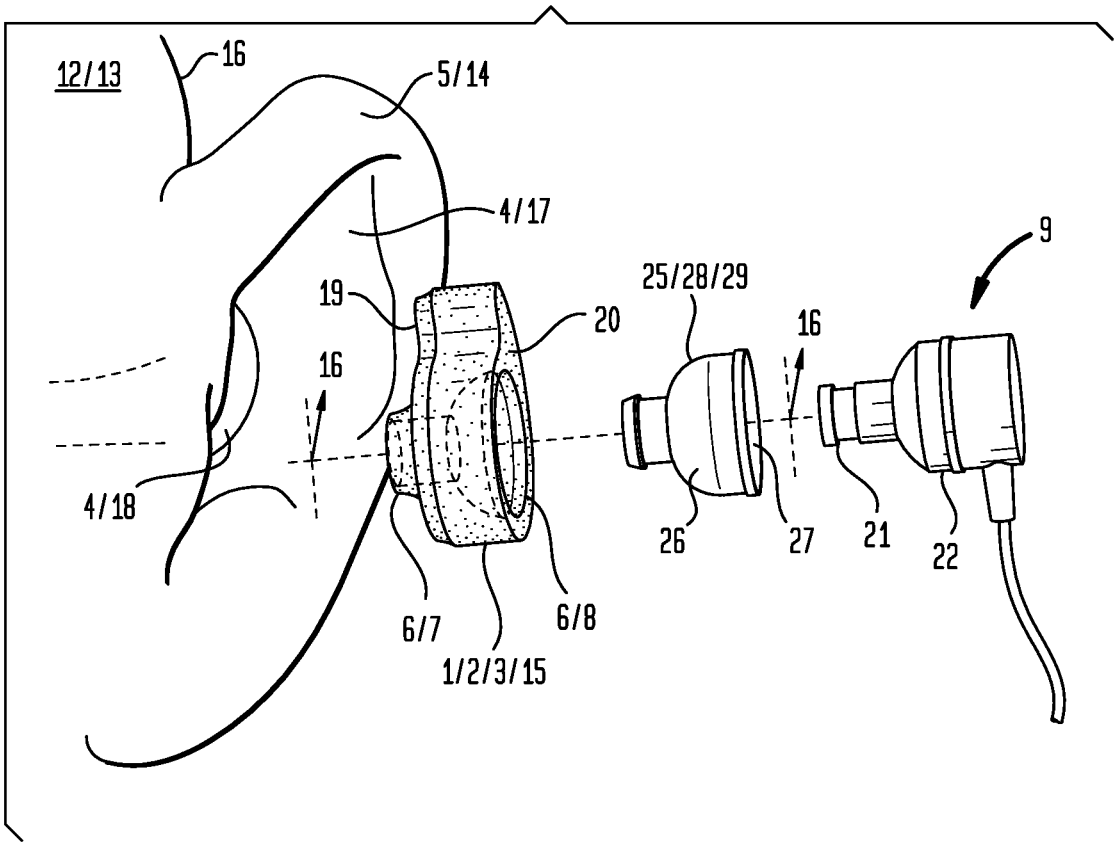
FIG. 9 is an exploded perspective side view of a particular embodiment of the inventive earpiece in a first fixed configuration having a passage and into which a conduit removably inserts to provide an internal surface configured to retain an in ear device.
Figure 17:
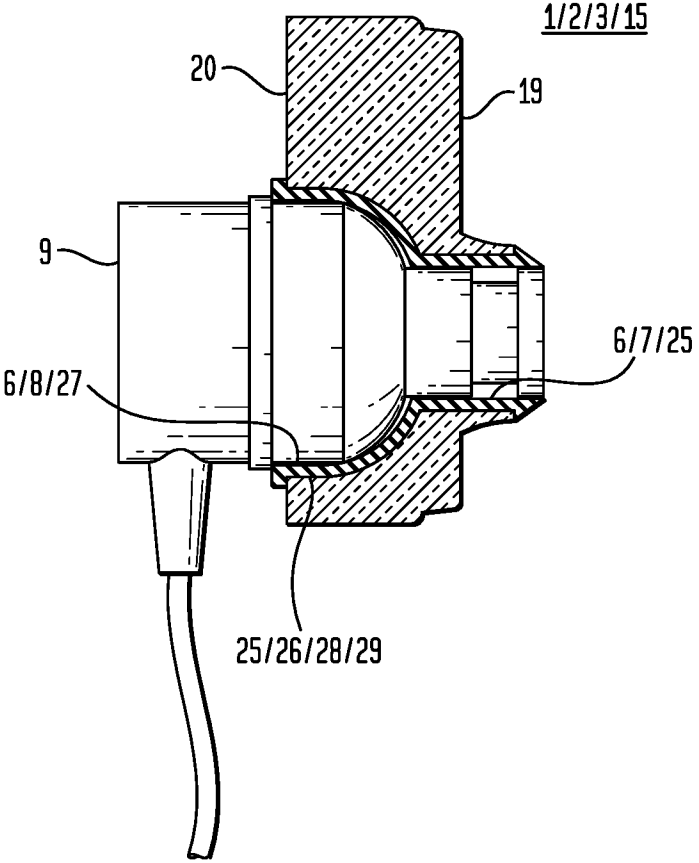
FIG. 17 is a cross section view 17-17 as shown in FIG. 12.
Figure 16:
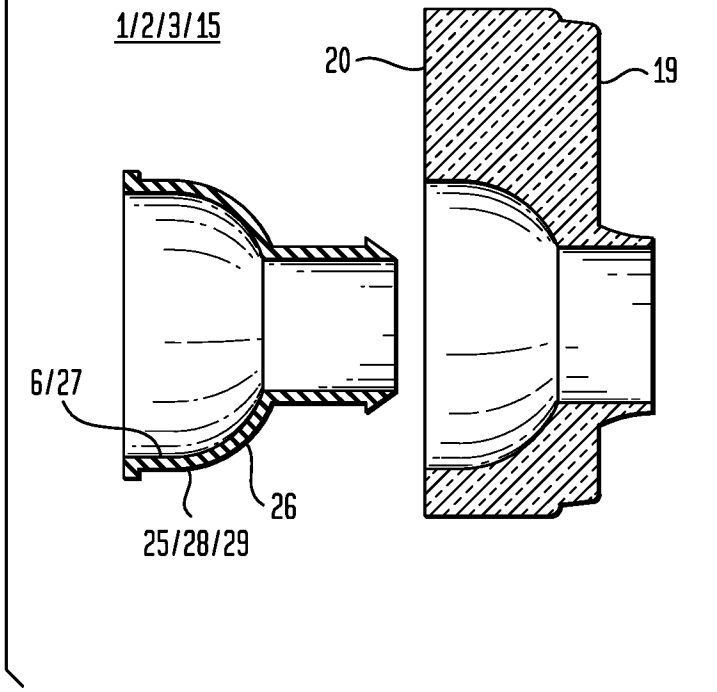
FIG. 16 is cross section view 16-16 as shown in FIG. 9.
Figure 18:
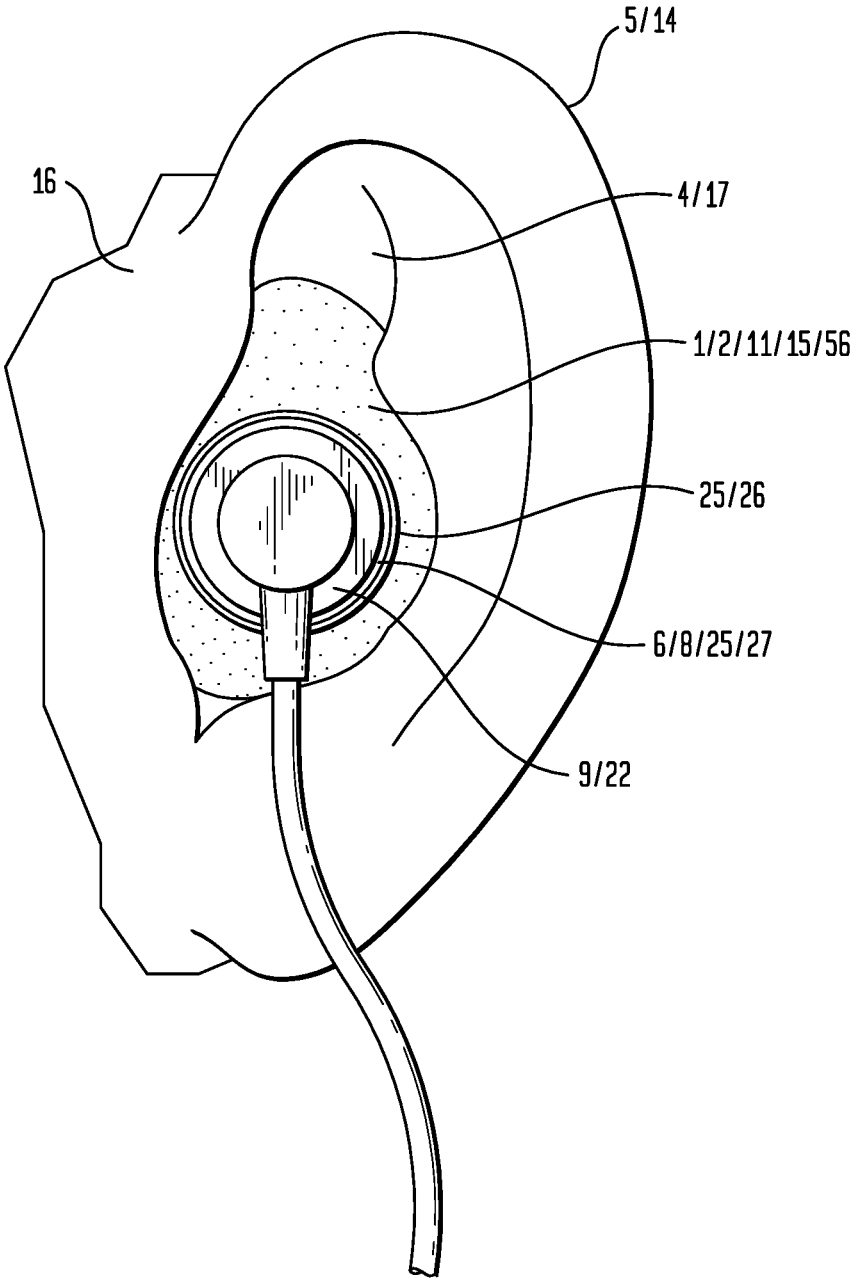
FIG. 18 is front view of the embodiment of the earpiece shown in FIGS. 10 through 15 in a second fixed configuration engaged within the outer ear and retaining a particular embodiment of an in ear device.

Now referring primarily to FIGS. 7, 8 and 17, the passage (6) which communicates between a first location (7) on the first portion (19) and a second location (8) on the second portion (20) of the external surface (2) and can be configured to receive the in ear device (9) at a location within the passage (6) to position a sound delivery element (21) proximate the first location (7) of the external surface (2) of the earpiece (1) and position the body (22) of the in ear device (9) proximate the second location (8) of the external surface (2). The passage (6) can be configured in a wide variety of structural forms to receive a correspondingly wide variety of structural forms of the in ear device (9). As shown in the example of FIGS. 7 and 8, where the in ear device (9) has a generally cylindrical structure, the passage (6) can define a corresponding generally cylindrical volume, or as further shown in the example of FIGS. 7 and 8 where the body (22) of the in ear device (9) has a greater diameter than the sound delivery element (21) the passage (6) can corresponding provide a first passage portion (23) of greater diameter than a second passage portion (24) for retention or releasable retention of the in ear device (9) within the passage (6). The earpiece (1) can have an external surface (2) in the first fixed configuration (3) which engaged with the outer ear (4) substantially aligns the passage (6) with the ear canal (18).

Now referring primarily to FIGS. 9 through 18, embodiments of the inventive earpiece (1) can further include a conduit (25) which defines the passage (6) which communicates between the first location (7) and the second location (8) on said external surface (2) of the earpiece (1). The conduit (25) can have a conduit external surface (26) which engages the moldable material (15) of the earpiece (1) and a conduit internal surface (27) which defines a configuration of the passage (6) adapted for retention or releasable retention of the in ear device (9) in the earpiece (1). The configuration of the conduit internal surface (27) of the conduit (25) can vary between embodiments to retain or releasably retain a wide variety of configurations of the in ear device (9).

Figure 10:
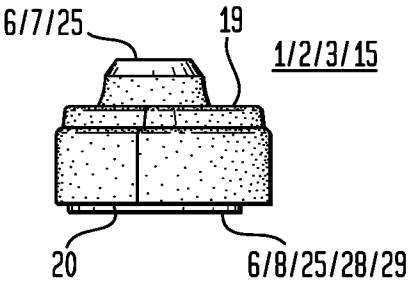
FIG. 10 is a top view of a particular embodiment of the inventive earpiece in a first fixed configuration.
Figure 12:
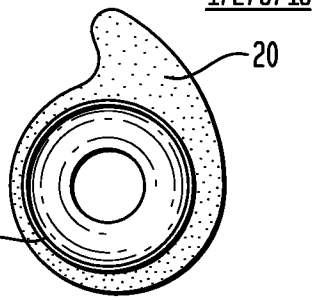
FIG. 12 is a front view of a particular embodiment of the inventive earpiece in a first fixed configuration.
Figure 11:
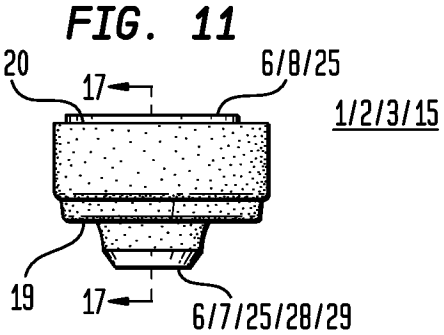
FIG. 11 is a bottom view of a particular embodiment of the inventive earpiece in a first fixed configuration.
Figure 14:
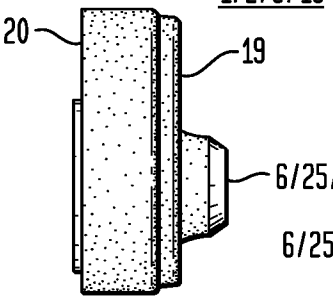
FIG. 14 is a first side view of a particular embodiment of the inventive earpiece in a first fixed configuration.
Figure 13:
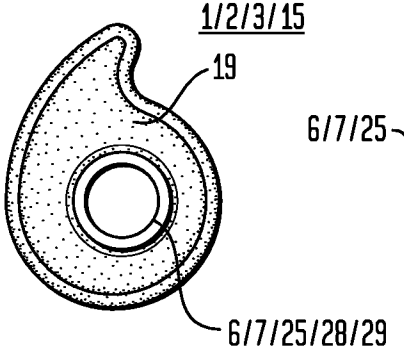
FIG. 13 is a back view of a particular embodiment of the inventive earpiece in a first fixed configuration.
Figure 15:
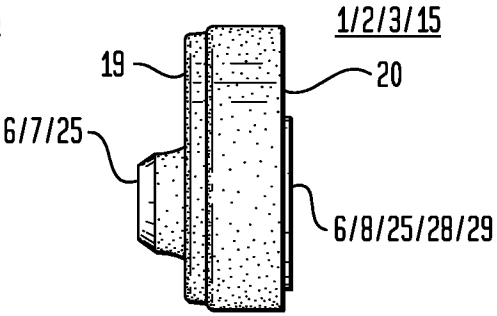
FIG. 15 is a second side view of a particular embodiment of the inventive earpiece in a first fixed configuration.

As to particular embodiments, the conduit (25) can take the form of an elastomer layer (28) formed integral with the amount of moldable material (15) to provide a one-piece conduit earpiece (1)(as shown in the examples of FIGS. 10 through 11) with the elastomer layer (28) providing the conduit internal surface (27) defining the configuration of the passage (6)(as shown by the example shown in FIG. 17).

As to other particular embodiments, the conduit (25) can take the form of a flexible elastomer insert (29) which removably couples within the passage (6) the earpiece (1) with the the flexible elastomer insert (29) providing the conduit internal surface (26) defining the configuration of the passage (6) to retain or releasable retain the in ear device (9) in the earpiece (1). A plurality of flexible elastomer inserts (28) each having substantially the same configuration of the conduit external surface (26) can provide a plurality of different configurations of the conduit internal surface (27) to retain or releasably retain a corresponding plurality of different configurations of the in ear device (9) by interchanging the conduit (25) removably coupled within the passage (6) to provide in one earpiece (1) a plurality of different configurations of the conduit internal surface (27).

Additionally, the conduit (25) can be provided with sufficient structural rigidity to maintain the configuration of the passage (6) for retention or releasable retention of the in ear device (9) even in the moldable condition (10) of the earpiece (1).

Figure 20:
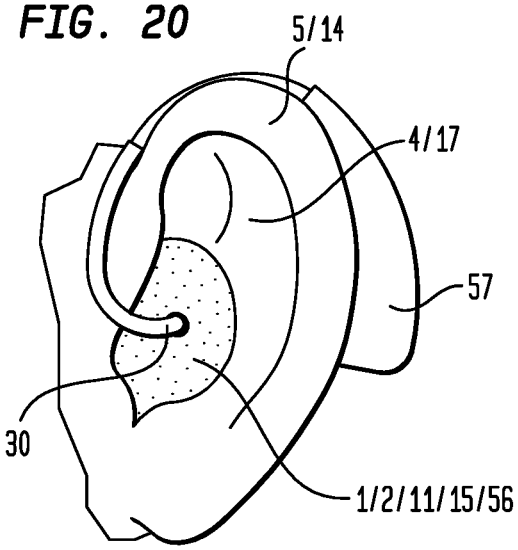
FIG. 20 is a front view of the embodiment of the earpiece in a second fixed configuration engaged within the outer ear and retaining the speaker tube shown in FIG. 19 of the hearing aid worn outside the ear.

Now referring primarily to FIGS. 19 and 20, particular embodiments of the conduit (25) can be configured to extend outwardly from the earpiece (1) to couple to a speaker tube (30) (also referred to as "hearing aid tube") of a hearing aid (31) worn outside of the ear (5) (or couple to a similar sound conveyance structure). The earpiece (1) can be configured as above described to provide an external surface (2) formed in a first fixed configuration (3). The earpiece (1) can be heated to achieve the moldable condition (10) of the external surface (3) which can be engaged to the outer ear (4) and cooled to provide the second fixed configuration (11) of the earpiece (1) with the conduit (25) extending a sufficient distance outward of the second portion (20) of the external surface (3) to couple the speaker tube (30)(as shown in the example of FIG. 20).

Figure 22:
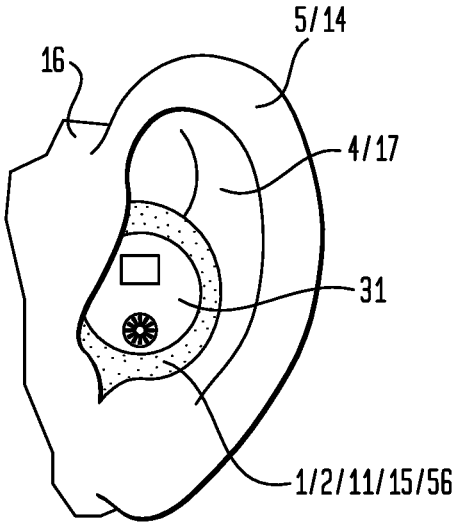
FIG. 22 is a front view of the embodiment of the earpiece shown in FIG. 21 in a second fixed configuration engaged within the outer ear and retaining the in ear hearing aid as shown in FIG. 21.

Now referring primarily to FIGS. 21 and 22, a similar embodiment of the earpiece (1) provide an external surface (2) formed in the first fixed configuration (3)(as shown in the example of FIG. 21) having a passage (6) configured to retain or releasably retain an in ear device (9) in the form of an in ear hearing aid (31). The earpiece (1) can be heated to achieve the moldable condition (10) of the external surface (2) which can be engaged to the outer ear (4) and cooled to provide the second fixed configuration (11) of the earpiece (1) with the passage (6), or the conduit (25) having a conduit internal surface (27) defining the configuration of the passage (6), which retains or releasably retains the in ear hearing aid (31)(as shown in the example of FIG. 22).

Figure 23:
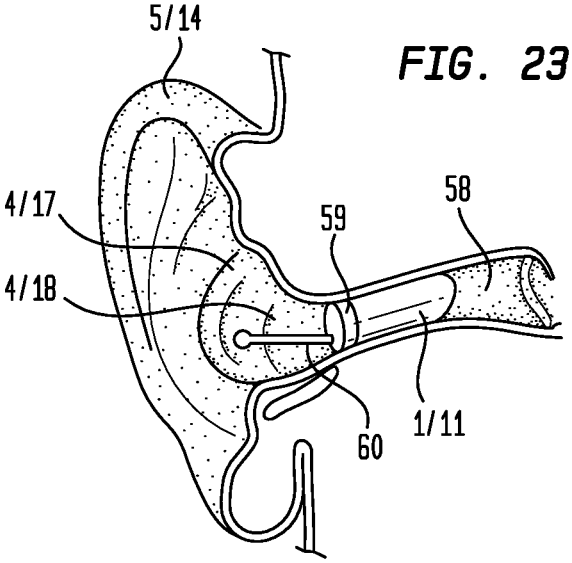
FIG. 23 is a cross section view of the ear which shows an embodiment of the earpiece in a second fixed configuration adapted to retain a particular embodiment of an in ear device in the form of an in ear canal hearing aid.

Now referring primarily to FIG. 23, particular embodiments of the invention having a first fixed configuration (3) similar to that shown in FIG. 21 can be utilized to retain an in ear canal hearing aid (59) as above defined and as shown in FIG. 23. The particular embodiments of the first fixed configuration (3) utilized with in ear canal hearing aids (59) further include an earpiece withdrawal element (60) which can be in the form of a stiff member or a flexible cord depending upon the application.

Figure 24:
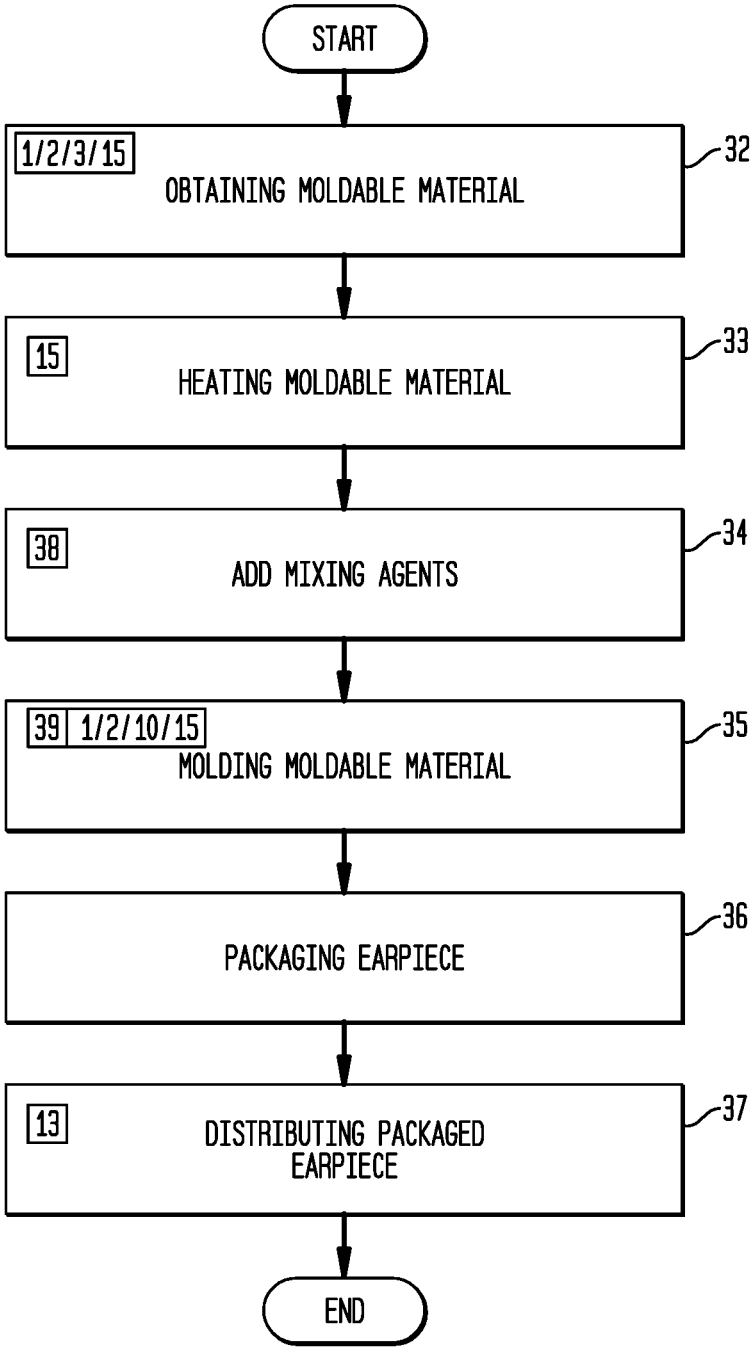
FIG. 24 is a block flow diagram of a method of providing a kit for an embodiment of a moldable earpiece system.

Now referring primarily to FIG. 24, embodiments of the invention can provide a kit (13). The kit (13) can be produced by obtaining an amount of moldable material (15) (as shown in step (32)), having physical properties as or similar to those above described or useful in making or using embodiments of the invention as described, such as a polycaprolactone polymer. The amount of moldable material (15) can be sufficiently heated (as shown in step (33)) to allow, if desired, admixing of one or more admixed agents (38) (as shown in step (34)) to alter one or more physical properties of the amount of moldable material (15) depending upon the application. The amount of moldable material (15) (whether or not, the amount of moldable material (4) includes one or more admixed agents (38)) can be sufficiently heated in step (33) to allow molding of the earpiece (1) (whether in a mold (39) or otherwise formed)(as shown in step (35)) having an external surface (2) in the first fixed configuration (3) disposable within the outer ear (4) of an ear (5) and having a passage (6) which communicates between a first location (7) and a second location (8) on the external surface (2) of the earpiece (1) for retention of an in ear device (9).

For example, polycaprolactone polymers can be obtained (step 32) and heated to about 65° C. (150° F.)(step 33) to allow admixing with one or more admixed elements (6)

(step 34) and molding an amount of the polycaprolactone polymers in a mold (39) (step 35) to produce the earpiece (1) having an external surface in the first fixed configuration (3). The earpiece (3) can be cooled to room temperature (or below about 40° C. (110° F.) to maintain the configuration imparted by the mold (39).

Production of the kit (13) can further include packaging of the earpiece (1) (as shown in step (36)) separate of any in ear device (9) or in combination with an in ear device (9). Subsequent, distributing of the kit (13) (as shown in step (37)) allows a plurality of earpiece wearers (14) access to a plurality of earpieces (1) having an external surface (2) that can be reconfigured from a first fixed configuration (3) to a second fixed configuration (11) having greater conformity with the wearer's (14) outer ear (4) for retention or releasable retention of an in ear device (9).

Figure 25:
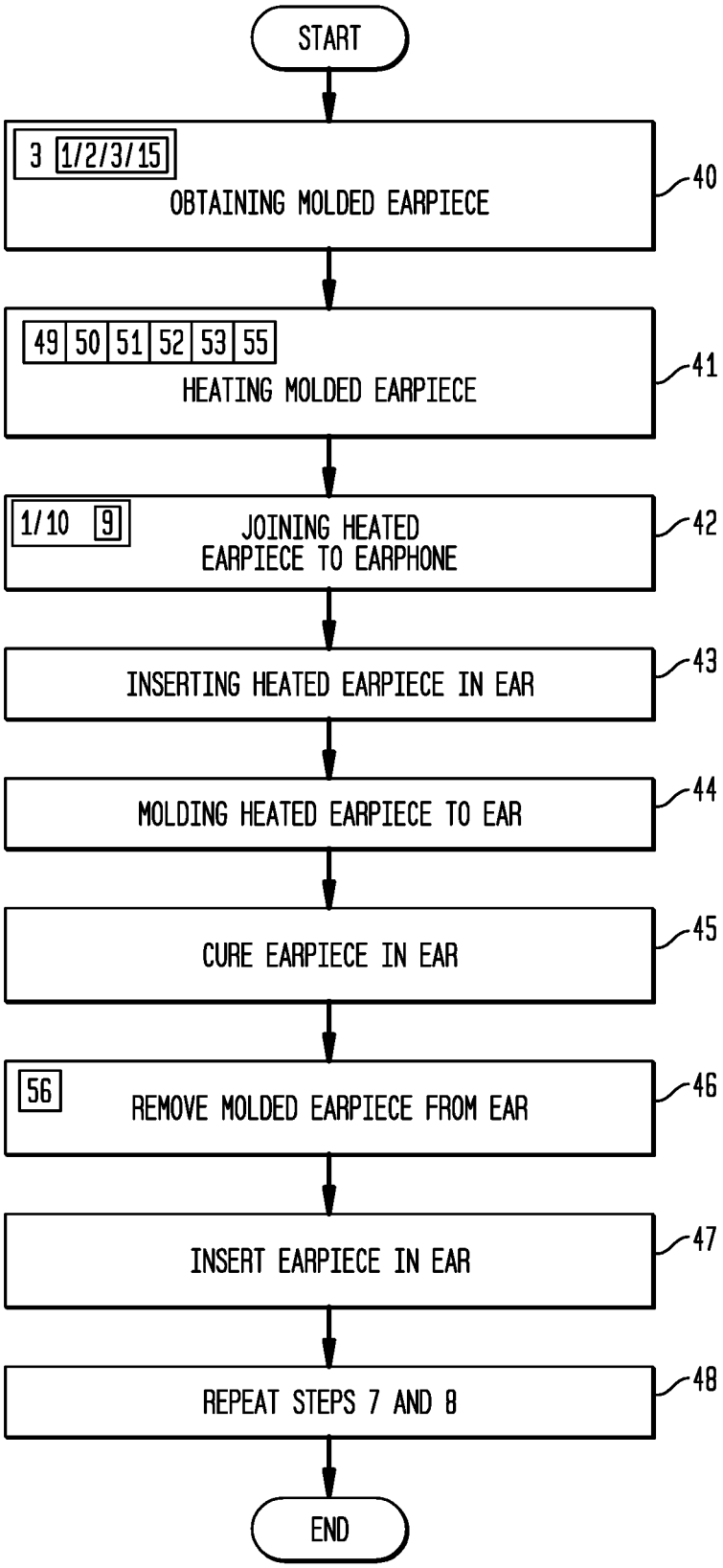
FIG. 25 is a block flow diagram of a method of sculpting an embodiment of a moldable earpiece.

Now referring primarily to FIG. 25, which provides block flow diagram of using embodiments of the inventive earpiece (1) whether or not obtained as a kit (13), or whether obtained with or separate from an in ear device (9). A first step includes obtaining an earpiece (1) having an external surface (2) disposed in a first fixed configuration (3) disposable within the outer ear (4) of an ear (5) and having a passage (6) which communicates between a first location (7) and a second location (8) on the external surface (2) of the earpiece (1) and adapted to retain or releasably retain an in ear device (9) in said earpiece (1)(as shown in step (40) and as shown in the examples of FIGS. 1, 2, 4, 7, 10 through 17, 19, and 21).

A second step includes heating the earpiece (1) to achieve a moldable condition (10) which allows reconfiguration of the external surface (2) (as shown in step 41). Heating to achieve the moldable condition (10) of the earpiece (1) as obtained in step (40) can be accomplished in a variety of ways. As a first illustrative example, the moldable earpiece (1) can be located in a heated enclosure (49). Where the earpiece (1) in the first fixed configuration (3) is formed from polycaprolactone (or other material(s) have same or similar physical properties), the moldable earpiece (1) can be heated within the heated enclosure (49) having sufficient temperature to achieve the molded condition (10). As to particular embodiments, the heated enclosure (49) can have a temperature maintained at about 70° C. (160° F.) and the earpiece (1) can be heated within the heated enclosure (49) for about 10 minutes. The moldable earpiece (3) can be removed from the heated enclosure (49) and allowed to sufficiently cool for engagement with the outer ear (4) (typically about 30 seconds).

As a second illustrative example, the moldable earpiece (1) can be located in an amount of liquid (50). The amount of liquid (50) can be any liquid which does not degrade the moldable material (15) of the earpiece (1) and which can hold a temperature sufficient to heat the earpiece (1) to achieve the moldable condition (10), such as an oil, alcohol, water, or the like, or combinations thereof. Typically, the amount of liquid (50) will be an amount of water (51). The amount of liquid (50) can be sufficiently heated to achieve the moldable condition (10). For example, where the moldable earpiece (3) is made from polycaprolactone polymer, the earpiece (1) can be heated in an amount of water (50) to a temperature of about 60° C. (140° F.) for about 5 minutes. The earpiece (1) can be removed from the heated water (50) and allowed to sufficiently cool for engagement with the outer ear (4) (typically about 30 seconds). As to particular embodiments, the earpiece (1) in the first fixed configuration (3) of the external surface (2) disposed in the amount of liquid (50) can be heated by exposing the earpiece (1) disposed in said amount of liquid (50) to an amount of microwave radiation (51) sufficient to achieve the moldable condition (10). As to particular embodiments, the earpiece (1) can be exposed to an amount of microwave radiation (51) sufficient to achieve the moldable condition (10).

As a third illustrative example, the earpiece (1) can be located in a flow of heated fluid (52). The flow of heated fluid (52) can be a flow of heated air (53); although the invention is not so limited. As to particular embodiments of the earpiece (3) made from polycaprolactone polymer (or other material have the same or similar physical properties), a flow of sufficiently heated air (53) can be obtained from conventional hair dryer (54). The settings of the hair dryer (55) as to temperature and flow rate can be adjusted to allow the earpiece (1) to be sufficiently heated to achieve the moldable condition (10), typically, within a period of about one minute to about 2 minutes. The earpiece (1) can be removed from the flow of heated air (53) and allowed to sufficiently cool for engagement with the outer ear (4) (typically about 30 seconds). The above illustrative examples are not intended to be limiting with respect to the method of heating the moldable earpiece (1) and other methods of heating the moldable earpiece (1) can be utilized, including, for example, a sand bath or salt bath.

Figure 5:
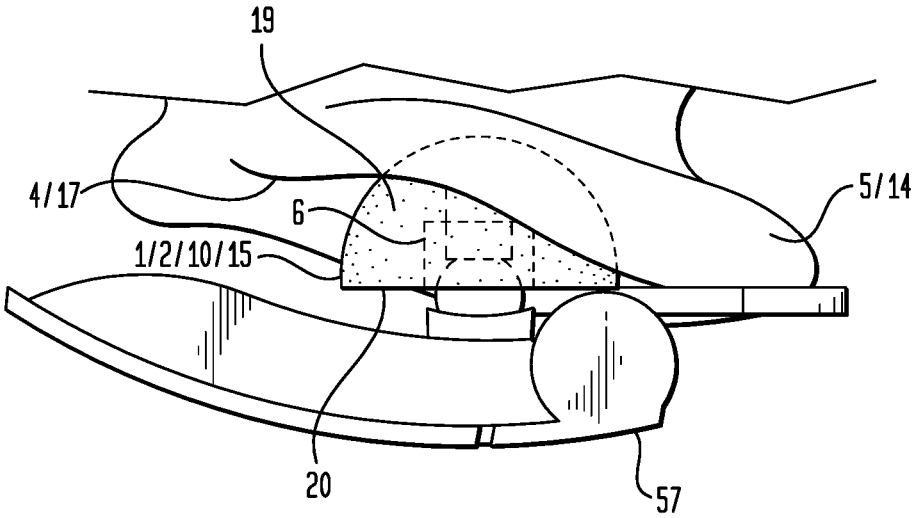
FIG. 5 is a top view which illustrates a step of a method of using an embodiment of the inventive earpiece in a first fixed configuration engaged to the particular in ear device shown in FIG. 4.
Figure 6:
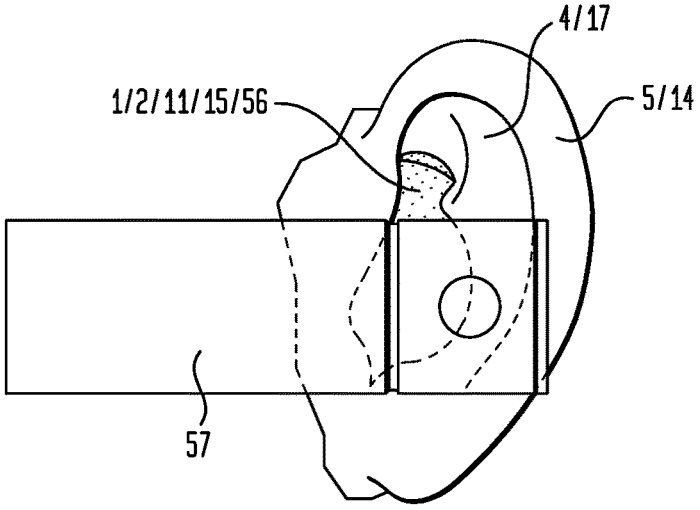
FIG. 6 is a front view which illustrates a step of a method of using an embodiment of the inventive earpiece in a second fixed configuration engaged to the particular in ear device shown in FIG. 4.

Again referring primarily to FIG. 25, by disposing the in ear device (9) into the passage (6) of the earpiece (1) in the moldable condition (10)(as shown in step 42 and as shown in the examples of FIGS. 5 and 8), the wearer (14) can forcibly urge the moldable material (15) of the earpiece (1) in contact with the in ear device (9) to reconfigure the passage (6) to retain or releasably retain the in ear device (9) in the earpiece (1). As to particular embodiments, by disposing the in ear device (9) in a conduit (25) (as shown in the example of FIG. 17) the wearer can maintain the configuration of the passage (6) defined by the conduit internal surface (27) to retain or releasably retain the in ear device (9) in the earpiece (1).

Again referring primarily to FIG. 25, the earpiece (1) in the moldable condition having the in ear device (9) retained in the passage (6) can be disposed in the outer ear (4) aligning the sound delivery element (21) of the in ear device (9) with the outer portion of the ear canal (18)(as shown in step 43 and in the examples of FIGS. 2 and 5). The earpiece (1) engaged with the outer ear (4) and having the sound delivery element (21) in alignment with the outer portion of the ear canal (18) can be molded (as shown in step (44)) by forcible urging of the fingers (56) to reconfigure the external surface (2) of the earpiece (1) to more closely conform to the engaged part of the outer ear (4) (as shown in the examples of FIGS. 3, 6, 18, 20, and 22).

Again referring primarily to FIG. 25, once the earpiece (1) has been molded by engagement with the outer ear (4), the earpiece (1) engaged with the outer ear (4) can be allowed to cool to ambient temperature, or sufficiently cool to achieve the second fixed condition (11) of the external surface (2) of the earpiece (1) which more closely conforms to the engaged part of the outer ear (4) (as shown by step 45). Typically, sufficient cooling can be achieve in a period of about five minutes to about ten minutes. Cooling allows the earpiece (1) to cure in a second fixed configuration (11) which conforms to the outer ear (4) of the wearer (14). During the cooling, the wearer (14) should not talk or otherwise move the mouth or face. The earpiece (1) can then be removed from the out ear (4) of the wearer (14) (as shown as step (41)). The earpiece (1) in the second fixed configuration (11) can be re-inserted into the outer ear (4) and removed from the outer ear (4) as desired (shown as steps (46) and (47). Additionally, steps 41 through 46 can be repeated to re-configure the external surface of the earpiece (1).

As can be easily understood from the foregoing, the basic concepts of the present invention may be embodied in a variety of ways. The invention involves numerous and varied embodiments of a moldable earpiece (1) or moldable earpiece system (12) which can be utilized for the production of a molded earpiece (56) by the process above described.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of "a moldable earpiece" should be understood to encompass disclosure of the act of "molding an earpiece"—whether explicitly discussed or not—and, conversely, were there effectively disclosure of the act of "molding an earpiece", such a disclosure should be understood to encompass disclosure of "a moldable earpiece" and even a "means for molding an earpiece." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

Moreover, for the purposes of the present invention, the term "a" or "an" entity refers to one or more of that entity; for example, "a light source" refers to one or more of those light sources. As such, the terms "a" or "an", "one or more" and "at least one" can be used interchangeably herein.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. The term "about" generally refers to a range of numeric values that one of skill in the art would consider equivalent to the recited numeric value or having the same function or result.

Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Thus, the applicant(s) should be understood to claim at least: i) each of the moldable earpieces herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

I claim:

1. A kit for a moldable earpiece, comprising:

an earpiece having first fixed configuration having an earpiece passage open between an earpiece first side and an earpiece second side, said earpiece heatable to achieve a moldable condition which allows reconfiguration of an external surface of said earpiece by engagement with an auricle of an ear;

a conduit insertable into said passage of said earpiece, said conduit having a conduit external surface which upon insertion of said conduit into said passage of said earpiece engages said earpiece in said first fixed configuration and an internal surface defining a conduit passage, said earpiece having said conduit inserted into said earpiece passage heatable to achieve said moldable condition, said earpiece in said moldable condition engaged with said auricle of said ear coolable to dispose said external surface of said earpiece in a second fixed configuration, said conduit internal surface retaining configuration of said conduit passage.

2. The moldable earpiece of claim 1, wherein said conduit passage defined by said conduit internal surface aligns with an ear canal of said ear.

3. The moldable earpiece of claim 1, wherein said conduit comprises an elastomer layer.

4. The moldable earpiece of claim 3, wherein said conduit comprises a flexible elastomer insert.

5. The moldable earpiece of claim 1, wherein said earpiece maintains said external surface in said first fixed configuration or said second fixed configuration at a temperature below about 40° C. (110° F.) and maintains said earpiece in said moldable condition at a temperature of above about 40° C. (about 110° F.) to about 65° C. (150° F.).

6. The moldable earpiece of claim 5, wherein said earpiece comprises an amount of polycaprolactone polymer having a number average molecular weight of between about 37,000 grams per mole and about 80,000 grams per mole.

7. The moldable earpiece of claim 1, wherein said earpiece achieves said moldable condition by heating said earpiece for a period of time within a heated enclosure maintained at about 70° C. (160° F.).

8. The moldable earpiece of claim 1, wherein said earpiece achieves said moldable condition by exposure of said earpiece for a period of time to an amount of microwave radiation.

9. The moldable earpiece of claim 1, wherein said earpiece achieves said moldable condition by disposal in an amount of liquid having temperature of between above 40° C. (about 110° F.) to about 65° C. (150° F.).

10. The moldable earpiece of claim 9, wherein said earpiece achieves said moldable condition disposed in an amount of liquid, said earpiece disposed in said amount of liquid exposed to an amount of microwave radiation.

11. The moldable earpiece of claim 10, wherein said amount of liquid comprises an amount of water.

12. The moldable earpiece of claim 1, further comprising an in-ear device retained by said conduit inserted into said earpiece passage is selected from the group consisting of: earphones, earplugs, earbuds, ear tips, ear tubes, ear sealing ballons, and in-ear hearing aids.

13. The moldable earpiece of claim 12, wherein said in-ear device is selected from the group consisting of: earphones, earplugs, earbuds, ear tips, ear tubes, ear sealing ballons, and in-ear hearing aids.

14. The moldable earpiece of claim 13, wherein said in-ear device is part of an apparatus selected from the group consisting of: headsets, head phones, telephones, blue tooth headphones, wireless headphones, and hearing aids.

* * * * *